United States Patent [19]

Ohsaka

[11] 4,111,145

[45] Sep. 5, 1978

[54] ROLL ON/OFF - LIFT ON/OFF CARGO VESSEL

[75] Inventor: Teruhiro Ohsaka, Muroran, Japan

[73] Assignee: Narasaki Shipbuilding Company Limited, Muroran, Japan

[21] Appl. No.: 800,059

[22] Filed: May 24, 1977

[30] Foreign Application Priority Data

Aug. 17, 1976 [JP] Japan ..... 51/97942

[51] Int. Cl.[2] ..... B63B 27/00

[52] U.S. Cl. ..... 114/72; 14/71.3; 114/78; 214/14

[58] Field of Search ..... 114/72, 73, 65 R, 78, 114/116; 14/69.5, 71.1, 71.3, 72.5; 105/368 R, 436; 214/12, 14, 85; 296/1 A

[56] References Cited

U.S. PATENT DOCUMENTS 2,333,289 11/1943 Bohnsack ..... 114/78

3,386,405 6/1968 Knight, Jr. et al. ..... 114/72

FOREIGN PATENT DOCUMENTS 856,801 12/1960 United Kingdom ..... 114/78

998,333 7/1965 United Kingdom ..... 114/72

*Primary Examiner*—Trygve M. Blix

*Assistant Examiner*—Sherman D. Basinger

*Attorney, Agent, or Firm*—Holman & Stern

[57] ABSTRACT

A cargo vessel which can be used in either or both of a roll on/off and a lift on/off mode, provided with a cargo hold which is covered with an inner bottom plating, a second deck, an auxiliary deck, an exposed deck, and having a plurality of transverse frame structures within the hold which are suitably spaced apart from each other and which have openings adapted to be opened or shut according to the use in roll on/off or lift on/off mode, such frame structures when open not interfering with free movement of roll on/off traffic around the decks, all hatches except a hatch having a liftable loading platform being closed by hatch covers, the front end of a movable slope-away being connected to the rear of the decks for use in the roll on/off mode, and the openings of the frame structures being closed by cover plates and the loading platform being lowered to the inner bottom plating for use in the lift on/off mode.

7 Claims, 4 Drawing Figures

ROLL ON/OFF - LIFT ON/OFF CARGO VESSEL

The present invention broadly relates to cargo vessels, and more particularly relates to a cargo vessel of the kind which is readily convertible, as occasion demands, either into a roll on/off cargo vessel adapted for loading or unloading self-running cargoes such as automobiles and fully-loaded trucks, or into a lift on/off cargo vessel adapted for loading or unloading general cargoes, such as grain, ore, coal, etc.

In general, a cargo vessel of the roll on/off type is equipped either at its stem or stern with ramp-ways appropriable to the quayside and with slope-ways connecting between the ramp-ways and decks. Via these ramp and slope-ways, vehicles can reach an exposed deck or other decks disposed in the cargo hold, or can go out of the ship.

In this respect, however, a certain problem occurs. To be more precise, any cargo vessel of this type is necessarily provided in its cargo hold with transversely-extending watertight bulkheads which divide the hold into many sections so as to give particularly a transverse strength to the hull structure. Such watertight bulkheads are not allowed to have therein openings big enough for vehicles to freely pass through, since the provision of such big openings causes the substantial lowering of the strength of the hull. Hence, in order to load vehicles into the hold or unload them therefrom, it has been necessary to provide a hoist or other lifting means for each of the hold sections divided by watertight bulkheads; thereby achieving the transport of the vehicles from one deck to another. Obviously, this not only makes the hull structure more complicated and expensive, but also makes loading or unloading operations more troublesome, and time-consuming.

It may of course be feasible, instead of using hoists or the like, to provide an opening gate in the side wall of the hull for each divided hold section so that vehicles can directly be driven into or out of each hold section via ramp and slope-ways. However, each of the opening gates has to be of a relatively large dimension, and therefore a necessary strength and watertightness of the hull structure can not be fully ensured.

Therefore, an object of the present invention is to provide a roll on/off cargo vessel in which transversely-extending watertight bulkheads are substantially dispensed with so as to ensure the smooth and safe passage of vehicles on each deck as well as to reduce the number of hoists to a minimum.

Another object of the present invention is to provide a roll on/off - lift on/off cargo vessel in which the cargo hold is optionally partitioned off into sections by attachable partitioning members so as to accommodate various sorts of cargoes whether in bulk, palletized or packaged.

A further object of the present invention is to provide a roll on/off - lift on/off cargo vessel in which in order to connect between a ramp-way and the various decks there is employed only one slopeway which, however, has an accessibility to any of the decks.

Still a further object of the present invention is to provide a roll on/off - lift on/off cargo vessel in which each of the hatch covers for closing hatches disposed in each deck has an upper surface substantially aligned with the deck surface so as not to interfere with or hinder the smooth and safe running of vehicles on the deck.

According to one aspect of the present invention instead of watertight bulkheads, there are provided a plurality of transverse frame structures in a spaced relationship to each other, each structure having large openings therein and reinforcing horizontal beams. The upper surface of each horizontal beam is generally aligned with the deck surface or the surface of the inner bottom plating, so that in the case of the vessel of this invention being used as a roll on/off cargo vessel the beams in no way interfere with the passage of vehicles. When the vessel is used as a lift on/off vessel, the openings of the frame structures are closed by easily-removable cover slats, whereby the cargo space is partitioned off into as many sections as required.

The above and other objects and features of the invention will be made more apparent, when the invention is described in more detail, by way of example, with reference to the accompanying drawings, in which.

Figure 1:
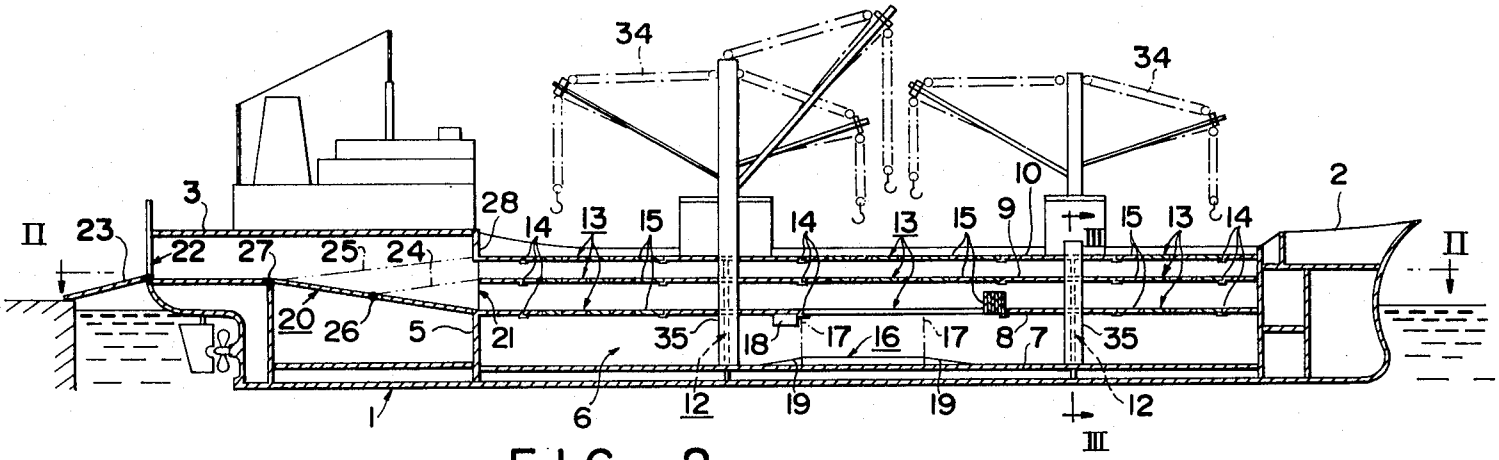
FIG. 1 is a longitudinal sectional view of the present invention.
Figure 2:
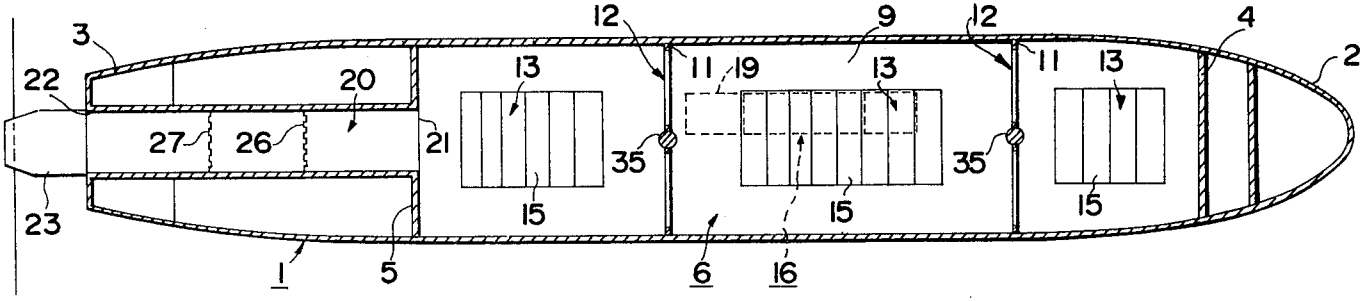
FIG. 2 is a horizontal sectional view taken along the line II—II of FIG. 1.
Figure 3:
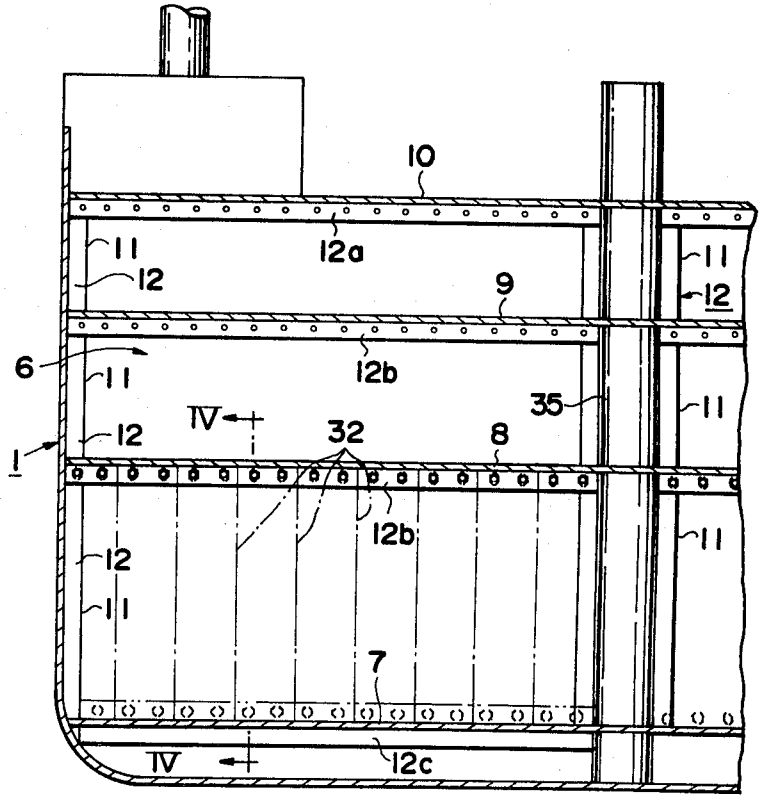
FIG. 3 is an enlarged sectional view taken along the line III—III of FIG. 1.

Referring now to FIG. 1 to 3, the hull of a cargo vessel of the present invention is generally indicated by the reference numeral 1. The hull 1 substantially comprises a stem 2, a stern 3 and a cargo hold 6 partitioned off from the stem 2 and stern 3 by a collision or forepeak bulkhead 4 and a after-peak bulkhead 5 respectively.

In the cargo hold 6, there are disposed, from the bottom of hull 1 upwardly, an inner bottom plating 7, a second deck 8 and an auxiliary deck 9, said hold 6 being covered by an exposed deck 10. The heights from the second deck 8 to the auxiliary deck 9 and from the latter to the exposed deck 10 are slightly bigger than that of a vehicle to be loaded into the hold 6, while the height from the inner bottom plating 7 up to the second deck 8 is considerably bigger than the vehicle's height.

In the cargo hold 6, where are also provided a plurality of transverse frame structures 12 which are suitably spaced apart from each other. Though in FIGS. 1 to 3 there are shown a pair of such frame structures 12 on both sides of each hold pillar 35, more frame structures 12 may of course be provided whenever required, even where there is no pillar 35. This frame structure 12 does not primarily serve as a strengthening or reinforcing member, but rather as a frame for forming a partition wall. Each of the structures 12, having a substantially same dimension as the cross section of the hold 6, is formed by channel bars and comprises a top horizontal beam **12*a* of which the upper surface abuts the lower face of exposed deck 10, two middle horizontal beams 12*b* and a bottom horizontal beam 12*c*. The upper surface of each of the two middle beams 12*b* is generally aligned with the deck surface of a second deck 8 or of auxiliary deck 9 respectively, while the upper surface of the bottom beam 12*c* is generally aligned with the surface of inner bottom plating 7**.

As can best be seen in FIG. 2, each of decks 8,9 and 10 is partitioned off by frame structures 12 into many sections, though only three sections are shown in the illustrated example, and each of the sections is provided with a hatch 13. The hatch 13 is provided along its peripheral edge with a support step 14 whose supporting face is located slightly below the respective deck surface, so that when a hatch cover 15 is placed on the support step 14 the upper surface of the hatch cover 15 can be substantially in alignment with the respective deck surface.

Each of the hatch covers 15 is preferably a folding or collapsible type. According to this invention, it may be formed with band-plates hinged together so that it can be folded up onto either side of support step 14. In FIG. 1, the central hatch cover 15 of second deck 8 is in a folded state so as to generally show how each hatch 13 is opened.

The reference numeral 16 is indicative of a liftable loading platform located below one of the hatches 13 of second deck 8 and adapted to carry vehicles from the second deck 8 to the inner bottom plating 7 or vice versa. This plate 16 is suspended from the second deck 8 preferably by wires 17, which are wound or unwound from a winch 18 fixed to the ;lower surface of second deck 8 so as to effect the transportation of vehicles between deck 8 and inner bottom plating 7. The plate 16 is provided at its front and rear edges respectively with removable ramps 19 so that, when the plate 16 is lowered fully to inner bottom plating 7, vehicles can be driven up to or off from the plate 16 more smoothly.

Within the stern 3 of the hull 1, there is provided a slope-way sloping down to the second deck 8 through afterpeak bulkhead 5, which has an opening 21 therein extending from the second deck 8 up to exposed deck 10. On the other hand, the stern 3 has at its rearmost portion an opening 22 extending up from the slope-way 20, said opening 22 being usually closed weather-tightly during a voyage by a ramp-way which is pivotally supported at the lower edge of the opening 22.

The aforementioned slope-way 20 leading to the second deck 8 is divided into three portions, which are pivotally interconnected to each other by hinges 26 and 27. Accordingly, when the slope-way 20 is folded about the hinge 26 until the front edge thereof reaches the rear end of auxiliary deck 9, the foremost portion of slope-way 20 can be used as another slope-way 24 now leading to auxiliary deck 9. Similarly, when the slope-way 20 is folded about the other hinge 27, the foremost and middle portions thereof form a slope-way 25 approaching the exposed deck 10. In this respect, however, it is preferable to support the hinged portions of slope-way 20 by a cable or the like so as to lessen the burden imposed upon those hinged portions. The reference numeral 28 indicates a door, which is closed to keep stern 3 weather-tight when slope-way 25 is not in use.

Figure 4:
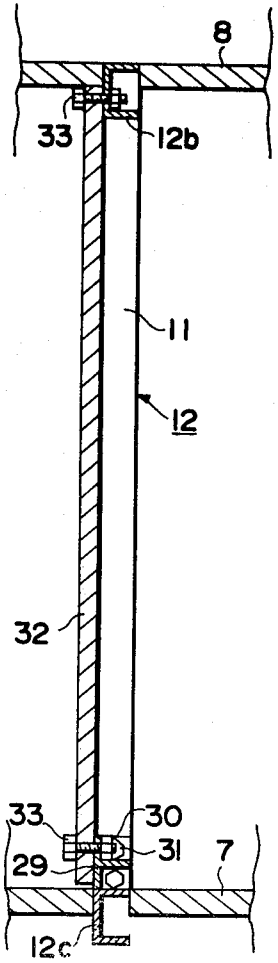
FIG. 4 is an enlarged sectional view taken along the line IV—IV of FIG. 3.

Referring now to FIGS. 3 and 4, attention is now directed to how to attach cover plates 32 to each frame structure 12 so as to close openings 11 formed in the structure 12. To begin with, as shown in FIG. 4, a transverse member 29 of T-shaped section, which is provided at both its ends with attachment pieces 30, is placed upon the bottom beam **12*c* in such a way that the front surface of the transverse member 29 is aligned with the front surface of frame structure 12. Then, the attachment pieces 30 of member 29 are secured to the lower side portions of frame structure 12 by means of bolts 31, and cover plates 32 are secured to the front surfaces of middle beam 12*b* and transverse member 29; thereby closing the opening 11 of the structure 12 and partitioning off the cargo space between the inner bottom plating 7 and the second deck 8 into many portions, as required. Other cargo spaces can similarly be divided, if necessary, by covering openings of the other structures 12** with cover plates.

In FIG. 1, the reference numeral 34 is indicative of derrick boom adapted to load or unload general cargoes.

As has been made obvious from the foregoing description, the kind of watertight bulkhead which has conventionally been used for reinforcement of the hull structure is not employed in cargo hold 6 of the vessel according to this invention. The required strength, particularly transverse strength is given to the hull structure by side or bottom longitudinal members, longitudinal bulkheads, inner bottom plating and decks.

In the use of the cargo vessels of this invention primarily for the roll on/off purpose, there is no need attaching any cover plates 32 to the frame structures 12, and therefore vehicles may be driven whenever required. Needless to mention, in this case, all hatches 13 except the hatch having a liftable loading platform 16 must be closed by hatch covers 15 beforehand, and, at the same time, the front end of the slope-way 20 must be aligned with the rear end of one of the decks 8,9 and 10.

According to this invention, each hatch cover 15 of the collapsible type, when unfolded, becomes substantially aligned with its corresponding deck surface so that the smooth and safe driving of vehicles on each deck can be assured; thereby achieving effective loading or unloading of vehicles.

Meanwhile, when the vessel of this invention is used for the lift on/off purpose, relatively large openings of each frame structure 12 are closed by the cover plates 32 in such a manner as mentioned before. In this case, as the loading platform 16 is not in use, it should be lowered fully to the inner bottom plating 7. Thus, cargoes, either in bulk or packaged, are loaded into or unloaded from hold 6 through each hatch 15 by derrick booms 34.

It should therefore be understood that when no cover plates 32 are attached maximum use of the cargo space of hold 6 is attained over its full length; thereby accommodating a larger number of vehicles than conventional cargo ships having the equivalent cargo space as well as achieving the safe and prompt driving of vehicles on each deck.

It should also be understood that by closing frame structures 12 by cover plates 32 hold 6 can be partitioned off into as many portions as required; thereby accommodating various kinds of cargoes.

It should further be understood that the foregoing description is merely a preferred embodiment of this invention and that various modifications can be made. For example, the ramp-way 23 and the slope-ways 20, 24 and 25 are not necessarily provided in the longitudinal direction, and may be provided in the stem 2 instead of the stern 3.

What we claim is:

1. A roll on/off-lift on/off cargo vessel comprising a hull, an upper exposed deck associated with said hull and having a plurality of hatch openings, means defining a plurality of superposed load surfaces within said hull beneath said exposed deck, said means defining said load surfaces comprising an inner bottom plating and at least one intermediate deck between said plating and said exposed deck, said plating and said exposed deck defining a cargo hold therebetween said at least one intermediate deck having a plurality of hatch openings, a plurality of open frame structures transversely disposed in said cargo hold in a spaced relationship to each other; each of said structures being dimensioned substantially to conform to the cross section of the hold, said open structures being readily closed by attachable partition plates and said structures each comprising side portions and a plurality of horizontal beams, said beams having upper surfaces substantially aligned with respective ones of said load surfaces to permit free movement of roll on/off traffic along said surfaces means providing roll on/off access to said load surfaces for traffic from outside the vessel and at least one liftable loading plate disposed to operate in one of said hatch openings of said at least one intermediate deck for transporting cargoes between the inner bottom plating and said at least one intermediate deck.

2. A cargo vessel according to claim 1, wherein the cargo hold is divided by said frame structures into a number of sections, and at least one hatch opening is provided in said exposed deck and in said at least one intermediate deck in each said section.

3. A cargo vessel according to claim 1, wherein each of said hatch openings is provided with a foldable hatch cover.

4. A cargo vessel according to claim 3, wherein each said hatch cover has an upper surface which is substantially aligned with the respective deck surface when the hatch cover is unfolded over the hatch opening to close the latter.

5. A cargo vessel according to claim 1 further including a plurality of transverse members each for attachment at the opposite ends thereof to the side portions of the respective frame structures; said members being adapted to support the lower end portions of partition plates for closing the openings of the frame structures.

6. A cargo vessel according to claim 1, including a pair of superposed intermediate decks and wherein said means providing roll on/off access to said load surfaces comprises a slope-way transversely divided into at least two portions articulatedly connected by transverse hinges for providing selective access to either one of said intermediate decks.

7. A cargo vesel according to claim 1, wherein said means providing roll on/off access to said load surfaces includes a ramp-way pivotaly supported on the hull.

* * * * *